US006808068B2

(12) United States Patent
Abada

(10) Patent No.: US 6,808,068 B2
(45) Date of Patent: Oct. 26, 2004

(54) PORTABLE DEVICE FOR DENTAL HYGIENE

(76) Inventor: Eli Eddy Abada, Rua Mateus Grow, 32, Sao Paulo (BR), 05415-050

( * ) Notice: Subject to any disclaimer, the term of this patent is extended or adjusted under 35 U.S.C. 154(b) by 0 days.

(21) Appl. No.: 10/291,002

(22) Filed: Nov. 8, 2002

(65) Prior Publication Data

US 2003/0088930 A1 May 15, 2003

(30) Foreign Application Priority Data

Nov. 14, 2001 (BR) ..... 8102729

(51) Int. Cl.[7] ..... A46B 5/04

(52) U.S. Cl. ..... 206/362.2; 15/167.1; 15/227; 206/361; 206/368; 206/229; D4/103; 132/308

(58) Field of Search ..... 15/167.1, 227, 15/110; D4/103; 206/361, 362.2, 368, 229; 132/308, 311

(56) References Cited

U.S. PATENT DOCUMENTS

| | | | | | |
|---|---|---|---|---|---|
| 463,309 | A | | 11/1891 | Schulze | |
| 1,157,413 | A | | 10/1915 | Nesper | |
| 1,894,413 | A | | 1/1933 | Nenning et al. | |
| 2,075,681 | A | * | 3/1937 | Welker | 401/7 |
| 2,077,540 | A | * | 4/1937 | Welker | 401/7 |
| 2,151,846 | A | * | 3/1939 | Greneker | 81/177.3 |
| 2,167,129 | A | * | 7/1939 | Sleeper | 15/195 |
| 2,396,548 | A | * | 3/1946 | Allen | 15/167.1 |
| 2,686,325 | A | * | 8/1954 | Silver | 15/188 |
| 2,966,691 | A | | 1/1961 | Cameron | |
| 2,968,827 | A | * | 1/1961 | Lawsine et al. | 15/184 |
| 2,983,276 | A | * | 5/1961 | Brown | 401/7 |
| 3,298,507 | A | * | 1/1967 | Micciche | 206/361 |
| 3,505,700 | A | * | 4/1970 | Rodriguez | 15/160 |
| 4,292,705 | A | * | 10/1981 | Stouffer | 15/110 |
| 4,617,694 | A | * | 10/1986 | Bori | 15/167.1 |
| 4,628,949 | A | * | 12/1986 | Mas et al. | 132/308 |
| 5,068,941 | A | * | 12/1991 | Dunn | 15/167.1 |
| 5,213,428 | A | * | 5/1993 | Salman | 401/7 |
| 5,228,433 | A | | 7/1993 | Rosen | 128/62 A |
| 5,392,482 | A | * | 2/1995 | Drulias et al. | 15/104.94 |
| 5,765,252 | A | | 6/1998 | Carr | 15/104.94 |
| 5,826,599 | A | | 10/1998 | Adams | 132/308 |
| 5,875,513 | A | * | 3/1999 | Reinold | 15/227 |

FOREIGN PATENT DOCUMENTS

GB 2043438 * 10/1980

* cited by examiner

*Primary Examiner*—Gary K. Graham
(74) *Attorney, Agent, or Firm*—Elman Technology Law, P.C.; Gerry J. Elman

(57) ABSTRACT

A portable device for dental hygiene comprising a new configuration of handleless toothbrush, of easy portability, whose body is manufactured of resilient plastic material with the approximate shape of a through thimble on the sides, to be specially fitted of the first phalange of an index finger, which has, incorporated in its lower surface, a plurality of bristle rows radially laid out and, in its upper surface, a set of slots in relief to massage the gums, constituting a small device that can be carried in the pocket or inside a small pouch or handbag, inside a package specially designed for its accommodation, that includes an internal container to store a small quantity of toothpaste, thus permitting that the user has a complete portable kit of dental hygiene at his disposal and comfort.

19 Claims, 6 Drawing Sheets

PORTABLE DEVICE FOR DENTAL HYGIENE

FIELD OF THE INVENTION

The present invention is localized, in a general way, in the dental hygiene field, especially in field of toothbrushes that do not use handles, and more particularly, in that of non-disposable portable toothbrushes, to be carried in a specially designed package, in pockets or inside a small pouch or handbag, hence the user may always have at his disposal a good quality toothbrush.

STATE OF ART

Devices for dental hygiene in the form of toothbrushes are objects of daily use, have been known since way back, those usually most found in the market are toothbrushes of the type that have handles to be held in the user's hand during their use.

Thus, the toothbrushes with a handle that, at one end, have a head with bristles for brushing are very well known and common.

Less common are the brushes for dental hygiene with no handle, which have been proposed in a way that they can be fixed to the user's finger, generally the index finger, that functions as the stem, or handle, of the said brush.

Though there are not easily found in the dental hygiene market, many models have been imagined and are incorporated in the state of the art.

Thus, for example, Schulze patent U.S. Pat. No. 463,309, of the end of the XIX century (1891), already published a device for cleaning teeth to be used applied on the user's finger, which did not use a bristle brush, as is known today, instead it only had a piece of cloth, in a format that wrapped round the finger.

On the other hand, Nesper patent U.S. Pat. No. 1,157,413 (October, 1915) made public a tooth cleaning device, to be applied as well on a finger for support, also made of cloth, to be used specially with a tooth paste or liquid or powder. This device used a string to be tied to the finger.

Nenning patent U.S. Pat. No. 1,894,413, of 1933, refers to a hand disposable sanitary article, also to be applied on the finger, produced of impermeable paper or cloth, having one closed end, with a sewn band to hold a set of brush bristles.

The Welker patents of 1937, U.S. Pat. No. 2,075,681 and U.S. Pat. No. 2,077,540 referred to devices for dental hygiene also adapted to a finger. The former regards to a device of temporary use, for voyagers, to be offered in hotels and rented cars, wrapped in sanitary paper, also disposable. The latter patent, similar to the previous one, was imagined to adapt itself to fingers of different sizes.

Cameron patent of 1961, U.S. Pat. No. 2,966,691, also referred to a disposable toothbrush, to be applied on one finger, characterised for comprising a body of material in such a form that it would work as a pocket, that would be relatively firm when dry and flexible when humid, containing zigzag edges with no bristles.

Bori patent of 1986, U.S. Pat. No. 4,617,694, also showed a device to be applied on a finger, characterised by being tubular, having a cleaning surface comprising a plurality of concave surfaces, with internal and external edges, such surfaces adapted to clean the tooth complementary surface.

Also the Salman patent, of 1993, U.S. Pat. No. 5,213,428, showed a disposable toothbrush, produced of biodegradable material, to be adapted to the index finger and that included a set of dehydrated toothpaste impregnated bristles, also having a hygiene accessory locate on the opposite side, containing a hygiene liquid.

Also in 1993, the Rosen patent, U.S. Pat. No. 5,228,433, was published regarding a dental applicator to be used on one of the user's fingers, in the form of a flexible foil with drugs, abrasive and cleaning material, not using bristles.

The Drulias patent of 1995, U.S. Pat. No. 5,392,482, also showed a toothbrush to be applied on one of the user's fingers, made by flexible material, which can be a prophylactic rubber, in the form of a finger glove, having a base where disposable bristles are located and that contain a impregnated toothpaste substance.

The Carr patent U.S. Pat. No. 5,765,252, of 1998, presented a device applied on the finger to brush teeth, which included a part constituted of tips and a part with a sheath, having it interior made of a wrinkly texture material so as not to slip off the finger and the sheath could roll along the device for better attachment. Bristles and small balls could form the part of tips, this part could be covered by dehydrated toothpaste.

Adams patent U.S. Pat. No. 5,826,599, also of 1998, presented substantially a tubular device for the finger having an open end to receive a finger and the other end closed, where a cleaning head was adapted. It made up a dental hygiene packet that included the toothbrush itself and a toothpaste package.

Finally, the Reinold patent U.S. Pat. No. 5,875,513 of March, 1999, was published revealing a toothbrush to be applied on one of the user's fingers, that includes an elastic cover, made of a resilient elastic material, which is placed on the inside of the finger's end, having a region of tips on its outside, constituted by cleaning bristle elements. An attachment element is provided on the second end of the elastic cover so that, when placed on a finger, the attachment element reaches the centre of the user's palm.

Although the toothbrush cleaning devices applicable to a finger, of the kind described above, already incorporated to the state the art, meet the purposes for which they were proposed, they have various problems and deficiencies, commented below, that have been solved by the present invention, object of this descriptive report.

The devices analysed were designed to be basically disposable and made of some cloth, impermeable paper or thin rubber, in the form of a tube, as described above, some using disposable bristles being, in some cases, impregnated with dehydrated toothpaste.

The devices presented in general must be attached to the user's finger by pressure, in its entire surface, sometimes tied by an elastic thread, or by a type of string, or even having an elastic part that pulls it up to the palm, or even constituting a complete uncomfortable glove.

All the devices until then imagined presented some or all the characteristics above and are disposable.

Such devices of the previous art have, therefore, a series of problems and disadvantages that, by the way, seems to fully justify their absence in the toothbrush market.

Examples of the deficiencies and disadvantages existing devices are:

They are difficult to be attached to the finger;

They easily get loose from the finger, except if they continuously pressured by the thumb;

They are of difficult manufacture, with complex structures, which need many manufacturing stages;

They are disposable, which does not allow that the user has a dental hygiene device permanently at his disposal;

They do not constitute a set protected by a packet specially designed for toothpaste and their accommodation.

Therefore, there is a need for a portable brush, non-disposable, that is efficient in cleaning teeth and massaging gums, that is easy to attach to the finger, not getting loose easily, and that is simple, easy to handle and easy to manufacture; and that has a package specially designed for its accommodation and protection and for carrying a quantity of toothpaste.

OBJECTIVES OF THE INVENTION

It is an objective of the present invention to offer a handless dental hygiene device, which is portable and non-disposable.

It is also an objective of the present invention to provide a dental hygiene device that is easy to attach to the user's finger and does not need additional resources for attachment, apart from the device itself.

It is also another objective of the present invention to provide a dental hygiene device that is possible to apply to different index fingers.

Obviously an objective of the present invention is to offer a dental hygiene device that cleans the teeth well and massages the gums properly.

Finally, it an objective of the present invention to provide a dental hygiene device that can be accommodated in a small protection package, adapted also to accommodate toothpaste.

GENERAL DESCRIPTION OF THE INVENTION

In order to meet the objectives above, a device was developed that comprises a new configuration of a handleless toothbrush, easy to be carried, having its body manufactured of resilient plastic material with the approximate form of a thimble with no sides, to be attached specially on the first phalange of the index finger, that has, incorporated in its lower surface, a plurality of bristle rows radially laid out and, on its upper surface, a set of slots in relief to massage the gums, constituting a small device possible to be carried in the pocket or inside a small pouch or handbag, within a package specially designed for its accommodation, which includes an internal container to store a small quantity of toothpaste, thus permitting that the user has a complete portable kit of dental hygiene at his disposal and comfort.

The present invention would be more easily understood by referring to the accompanying drawings, that exemplify a proffered embodiment, and that will be described below.

DETAILED DESCRIPTION OF THE INVENTION

Figure 1:
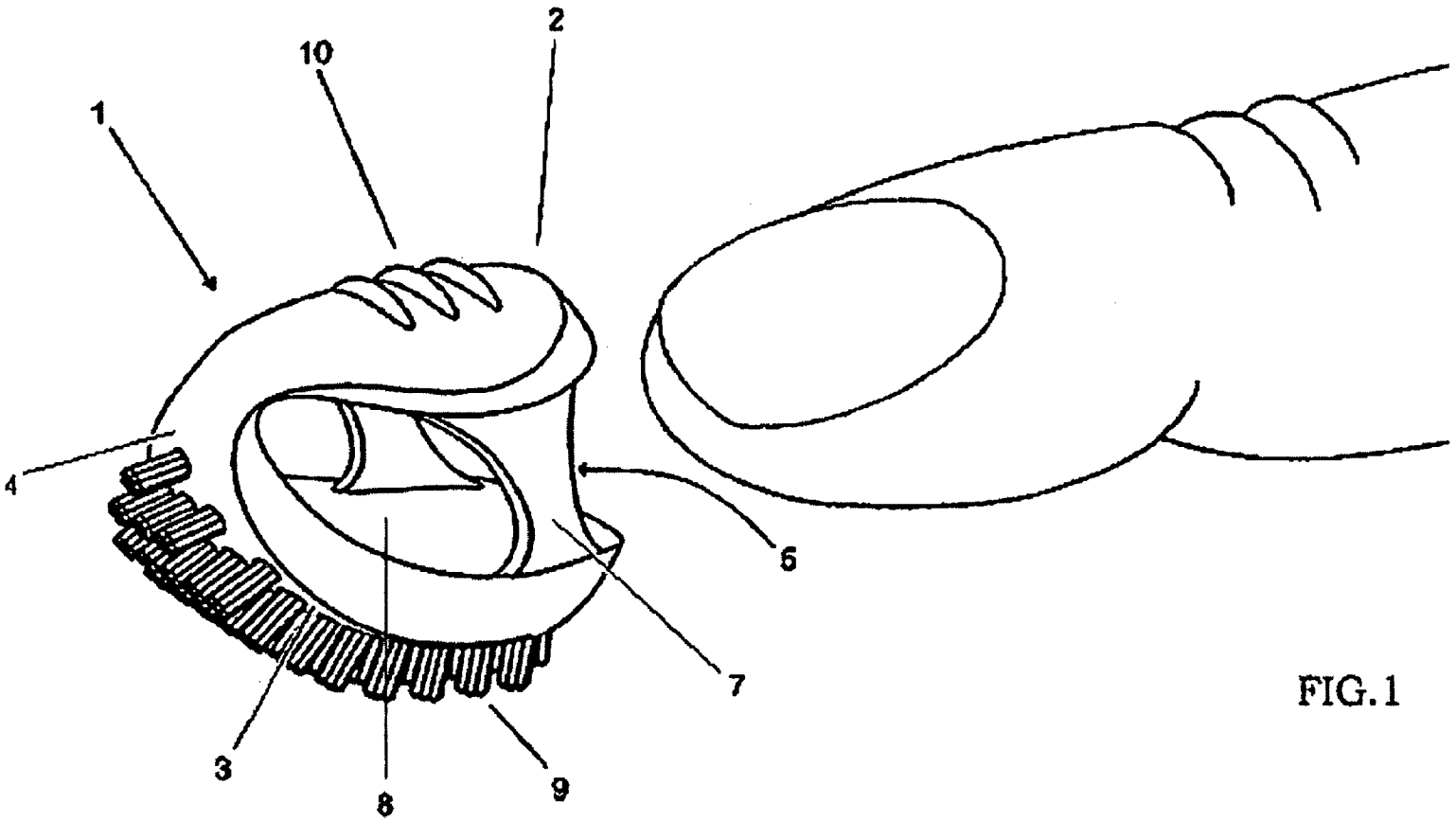
FIG. 1 is a front-upper angle view of a preferred embodiment of the toothbrush component of the PORTABLE DEVICE FOR DENTAL HYGIENE, according to the present invention.
Figure 2:
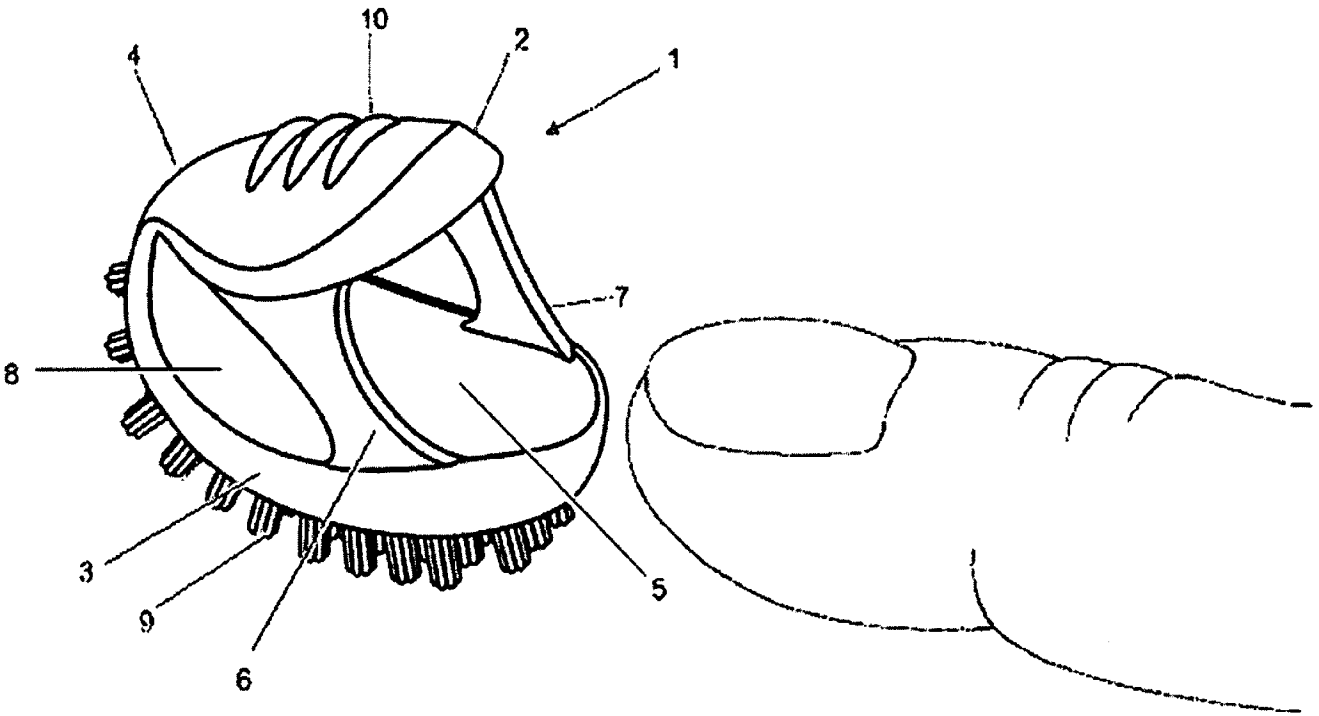
FIG. 2 is a back-upper view of a preferred embodiment of the toothbrush component of the PORTABLE DEVICE FOR DENTAL HYGIENE, according to the present invention.
Figure 4:
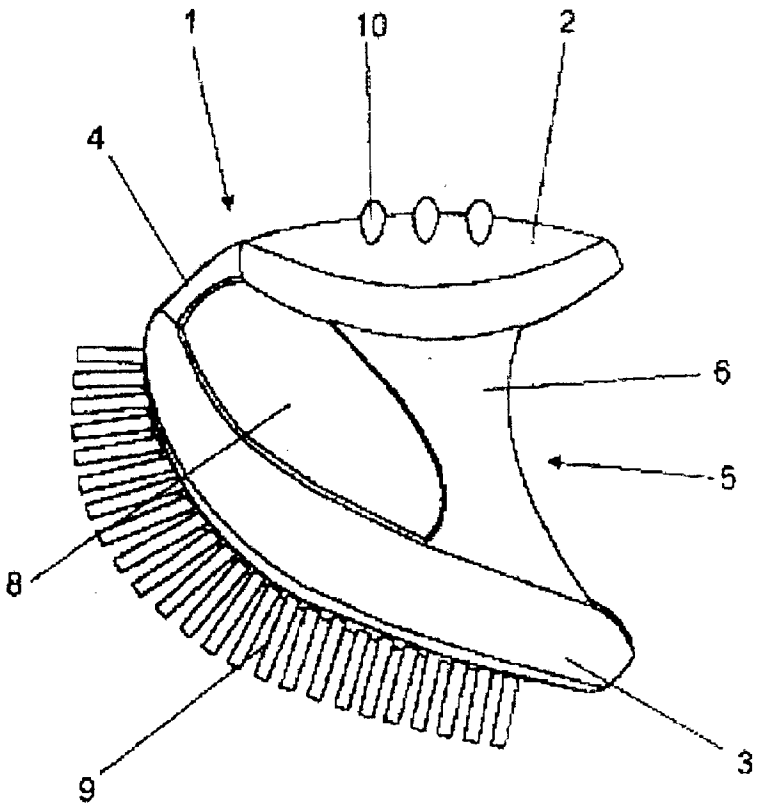
FIG. 4 is a side view of a preferred embodiment of the toothbrush component of the PORTABLE DEVICE FOR DENTAL HYGIENE, according to the present invention.
Figure 3:
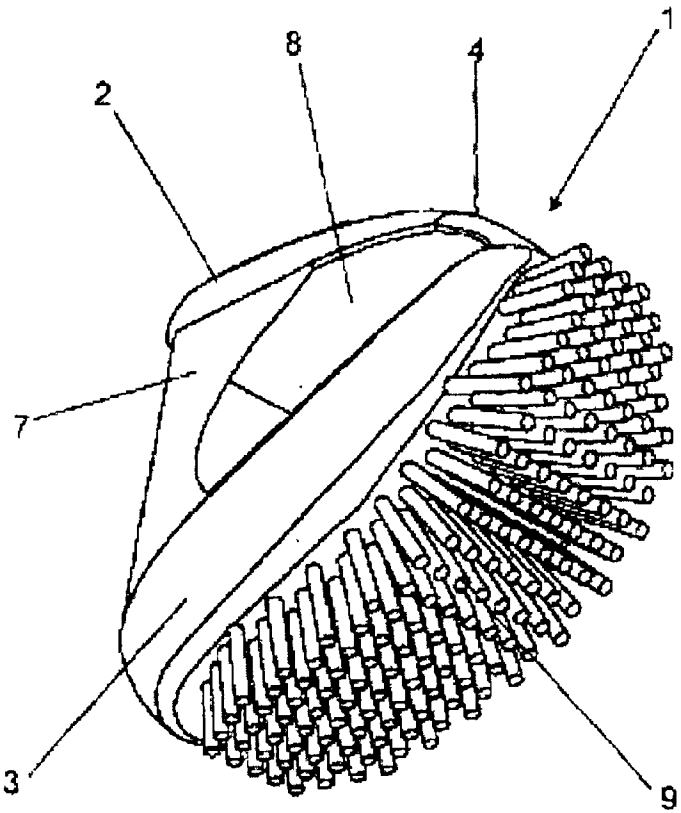
FIG. 3 shows a side lower perspective view of a preferred embodiment of the toothbrush component of the PORTABLE DEVICE FOR DENTAL HYGIENE, according to the present invention.
Figure 7:
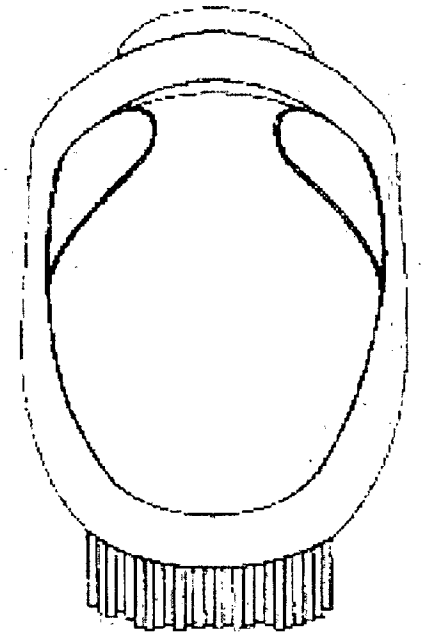
FIG. 7 is a back view of a preferred embodiment of the toothbrush component of the PORTABLE DEVICE FOR DENTAL HYGIENE, according to the present invention.
Figure 6:
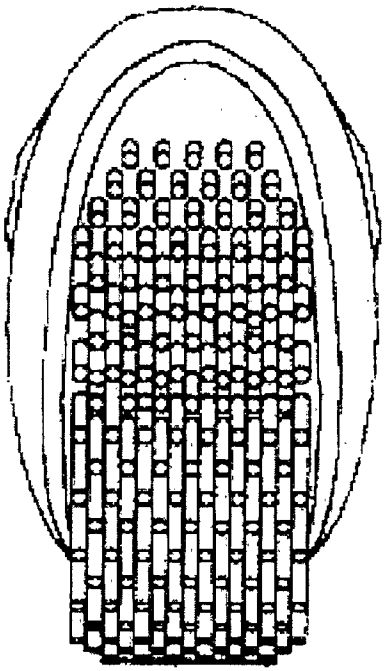
FIG. 6 represents a lower view of a preferred embodiment of the toothbrush component of the PORTABLE DEVICE FOR DENTAL HYGIENE, according to the present invention.
Figure 5:
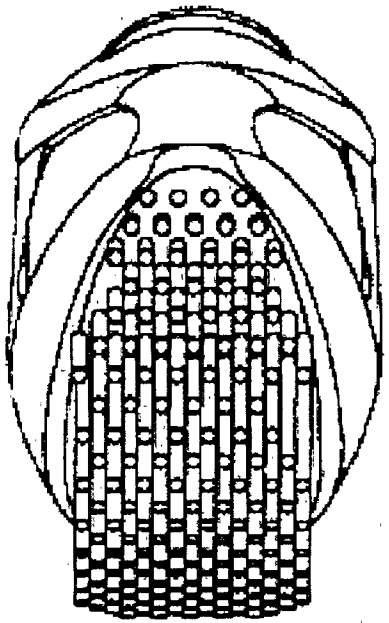
FIG. 5 shows a front view from above of a preferred embodiment of the toothbrush component of the PORTABLE DEVICE FOR DENTAL HYGIENE, according to the present invention.

To better understand the present invention, a detailed description of a preferred embodiment is given below referring to the attached drawings.

According to the attached drawings, and their details, particularly FIGS. 1 to 10, the present invention, PORTABLE DEVICE FOR DENTAL HYGIENE, is comprised, first, by a plastic material injected one piece body, made in the form of a through thimble (1), formed by two basic integrated parts, an upper (2) and a lower one (3), like inclined sheets, in relation to each other, so that their front ends can converge and be joined by a connecting wall (4), whilst the back ends separate enough to form a fitting opening for a finger end (5) and, at this point, the said separated back ends are joined on the sides by-wall stretches (6) and (7), which form side openings (8), also from the lower surface of the basic part (4) a plurality of cylindrical bristles (9) emerge, ending the configuration of two different parts, one defined by the body (1) and the other by the brushing bristles (9), being that the former has a hollow semi-oval shape that, through the open part (5), provides ergometric means for the entry of the end of the index or idle finger and, in that same position, the toothbrush is used to brush the teeth.

The part in the form of upper sheet (2), as well as having transversal massaging bulges (10), also has a slight sideway bend which reflects internally an arched and ergonomic configuration to adjust the perfect fitting over the user's fingernail region.

The basic sheet shaped part (3): its internal surface is dome-shaped and eases the ergometric fitting of the lower region of the fingertip.

The side connections (6) and (7) stretch so, combined with the basic sheet shaped parts (2) and (3), they form a real elastic or flexible band that grabs the device on the user's finger phalange.

The lower surface of the basic sheet shaped part (3), when seen from the side, also has an arched profile, from which emerge the bristles (9) distributed in a way that, as a whole, said bristles also define an arched brush.

The PORTABLE DEVICE FOR DENTAL HYGIENE is accommodated by a hollow bullet shaped package (100), with a circular base (11), constituted by three parts, a lower one (12), cup shaped, for storing a certain quantity of toothpaste (15), an intermediate part (13), whose shape is approximately a cylindrical slightly oval surface, for the partial accommodation of the brush (1) that is part of the set, and an upper part (14), which partially accommodates said brush and constitutes the top of the set.

Figure 8:
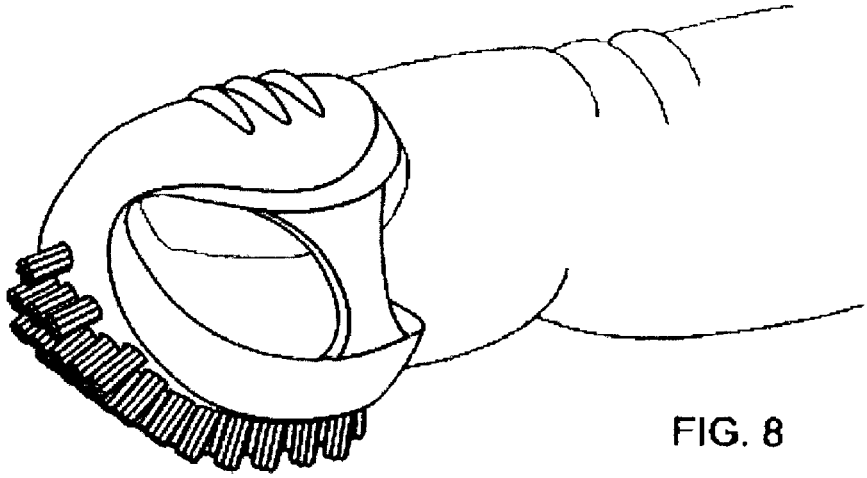
FIG. 8 shows a view of a preferred embodiment of the toothbrush component of the PORTABLE DEVICE FOR DENTAL HYGIENE, when applied to the user's index finger, highlighting how to use it, according to the present invention.
Figure 9:
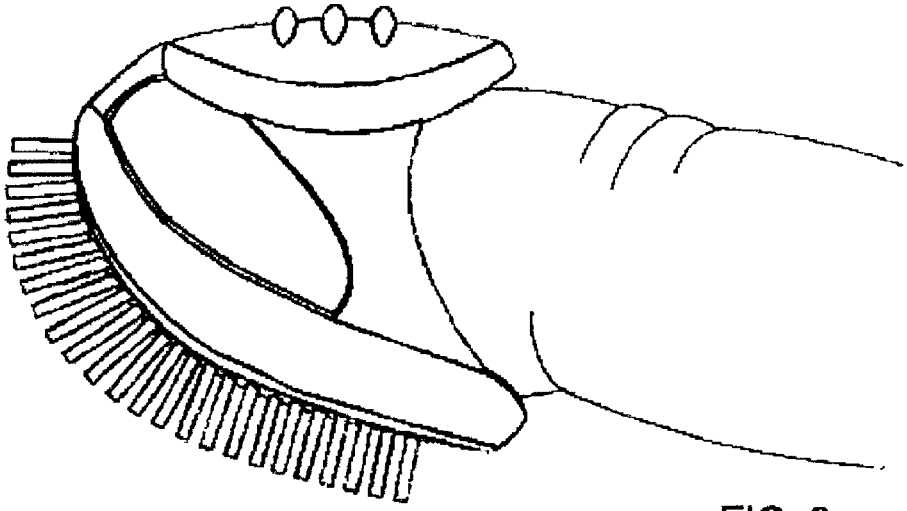
FIG. 9 shows a side view of a preferred embodiment of the toothbrush component of the PORTABLE DEVICE FOR DENTAL HYGIENE, also highlighting how to use it, according to the present invention.
Figure 10:
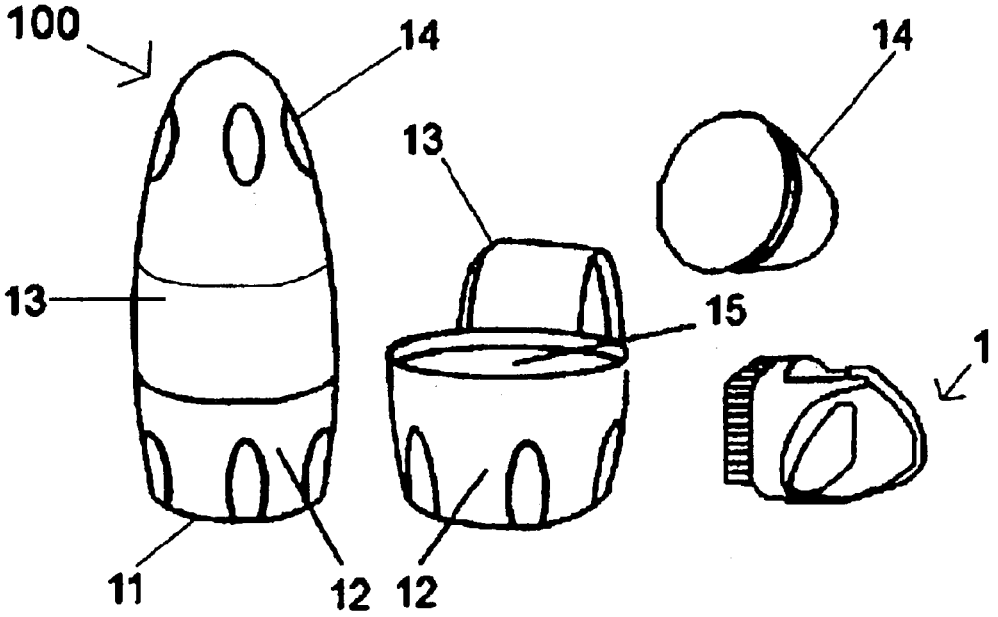
FIG. 10 shows views of the accommodating package for the toothbrush and toothpaste of a preferred embodiment of the PORTABLE DEVICE FOR DENTAL HYGIENE, with the said package closed and opened in its three component parts.

As FIGS. 8, 9 and 10 also show, that embodiment of the PORTABLE DEVICE FOR DENTAL HYGIENE, due to its configuration and use, is possible to be manufactured with reduced dimensions, for example, 2.5 cm×2.5 cm×1.5 cm, defining an ergometric device of easy portability, proper to be carried in a pocket or a very small handbag, inside its accommodating package, specially designed, and that is part of the invention and, this way, the user always has a toothbrush handy, mainly during a trip or when the user is in transit.

Such circumstances include, but are not limited to military exercises or combat, pleasure trips for camping and fishing etc, business trips that include transits in airports or highways, people who need to sleep in hospitals as companions of third parties, people who take part in conferences for one or two days away from home, students that do not eat at home, hotel guests and similar cases.

What is claimed is:

1. A brush for dental hygiene, comprising a thimble-shaped body (1) of plastic material having a hollow semi-oval shape and brushing bristles (9) emerging therefrom, the body (1) being formed by two integrated basic parts, an upper sheet-shaped part (2) and a lower sheet-shaped part (3), wherein the sheet-shaped parts (2,3) are curved and inclined with respect to each other and each has a front end and a back end, and wherein the respective front ends of the upper part (2) and lower part (3) are joined by a connecting wall (4), and the back ends thereof are separated enough to form an opening (5) to fit a user's finger and, at or near this opening (5), the said back ends are joined on the side by side connections (6,7) of one piece with the sheet-shaped parts (2,3) and connecting wall (4) and together therewith defining a pair of side openings (8), and wherein from the exterior surface of the lower part (3) a plurality of brushing bristles (9) emerge, whereby the opening (5) provides ergonomic means for the entry of the tip of the user's index or ring finger and in that position, the brush is capable of being used as a toothbrush.

2. A brush according to claim 1, wherein the upper part (2) has transversal bulges (10) extending outwardly therefrom, whereby the user's gums may be massaged.

3. A brush according to claim 2, wherein the upper part (2) also has a slight transversal bend, which reflects internally an arched and ergonomic configuration fitting over the user's fingernail.

4. A brush according to claim 1, wherein the lower part (3) has a concave internal surface that ergonomically fits the lower region of the user's fingertip.

5. A brush according to claim 1, wherein side connections (6) and (7) stretch so that, combined with the sheet-shaped parts (2) and (3), they form a flexible elastic band that allows the brush to grab onto the user's fingertip.

6. A brush according to claim 1, wherein the lower sheet-shaped part (3) has an outer surface shaped such that the bristles (9) which emerge therefrom define a brush having an arched shape as viewed from the side.

7. A portable device for dental hygiene, comprising a brush according to claim 1, a hollow bullet-shaped package (10), comprising a cup-shaped lower part (12) adapted to store a quantity of toothpaste (15), an intermediate part (13), and an upper part (14) which partially accommodates said brush and forms the top of the set.

8. A portable device for dental hygiene according to claim 7, wherein the intermediate part (13) and upper part (14) are adapted to accommodate the brush therein.

9. A portable device for dental hygiene according to claim 8, wherein the intermediate part (13) has a cylindrical slightly oval surface and a circular base.

10. A brush for dental hygiene, comprising a thimble-shaped body (1) of plastic material having a hollow semi-oval shape and brushing bristles (9) emerging therefrom, the body (1) being formed by two integrated basic parts, an upper sheet-shaped part (2) and a lower sheet-shaped part (3), wherein the sheet-shaped parts (2,3) are curved and inclined with respect to each other and each has a front end and a back end, and wherein the respective front ends of the upper part (2) and lower part (3) are joined by a connecting wall (4), and the back ends thereof are separated enough to form an opening (5) to fit a user's finger and, at or near this opening (5), the said back ends are joined on the side by side connections (6,7), and wherein the back end of the upper part (2) is end-rounded to define a U-shaped portion to fit over the base of the user's fingernail region, and wherein from the exterior surface of the lower part (3) a plurality of brushing bristles (9) emerge, whereby the opening (5) provides ergonomic means for the entry of the tip of the user's index or ring finger and In that position, the brush is capable of being used as a toothbrush.

11. A brush according to claim 10, wherein the upper part (2) has transversal bulges (10) extending outwardly therefrom, whereby the user's gums may be massaged.

12. A brush according to claim 11, wherein the upper part (2) also has a slight transversal bend, which reflects internally an arched and ergonomic configuration fitting over the user's fingernail.

13. A brush according to claim 10, wherein the lower part (3) has a concave internal surface that ergonomically fits the lower region of the user's fingertip.

14. A brush according to claim 10, wherein side connections (6) and (7) stretch so that, combined with the sheet-shaped parts (2) and (3), they form a flexible elastic band that allows the brush to grab onto the user's fingertip.

15. A brush according to claim 10, wherein the sheet-shaped parts (2,3), side connections (6,7) and connecting wall (4) together define a pair of side openings (8).

16. A brush according to claim 10, wherein the lower sheet-shaped part (3) has an outer surface shaped such that the bristles (9) which emerge therefrom define a brush having an arched shape as viewed from the side.

17. A portable device for dental hygiene, comprising a brush according to claim 10, a hollow bullet-shaped package (10), comprising a cup-shaped lower part (12) adapted to store a quantity of toothpaste (15), an intermediate part (13), and an upper part (14) which partially accommodates said brush and forms the top of the set.

18. A portable device for dental hygiene according to claim 17, wherein the intermediate part (13) and upper part (14) are adapted to accommodate the brush therein.

19. A portable device for dental hygiene according to claim 17, wherein the intermediate part (13) has a cylindrical slightly oval surface and a circular base.

* * * * *